US009630402B2

(12) United States Patent
Kimura et al.

(10) Patent No.: US 9,630,402 B2
(45) Date of Patent: Apr. 25, 2017

(54) INK JET HEAD AND PRINTING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Mamoru Kimura, Tokyo (JP); Noboru Nitta, Shizuoka (JP); Teruyuki Hiyoshi, Shizuoka (JP); Shunichi Ono, Shizuoka (JP); Tomohisa Yoshimaru, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/924,984

(22) Filed: Oct. 28, 2015

(65) Prior Publication Data

US 2016/0121606 A1 May 5, 2016

(30) Foreign Application Priority Data

Oct. 31, 2014 (JP) ..... 2014-223402

(51) Int. Cl.
*B41J 2/045* (2006.01)
*B41J 29/393* (2006.01)

(52) U.S. Cl.
CPC ..... *B41J 2/04588* (2013.01); *B41J 2/04543* (2013.01); *B41J 2/04573* (2013.01); *B41J 2/04581* (2013.01); *B41J 2/04595* (2013.01); *B41J 2/04596* (2013.01); *B41J 2202/10* (2013.01)

(58) Field of Classification Search
CPC ..... B41J 2/04581; B41J 2/04588
See application file for complete search history.

(56) References Cited

U.S. PATENT DOCUMENTS 6,454,377 B1 * 9/2002 Ishizaki ..... B41J 2/04541 347/10
2006/0214899 A1 * 9/2006 Kondo ..... B41J 2/04521 345/94
2007/0052743 A1 * 3/2007 Kawauchi ..... B41J 2/04588 347/11

(Continued)

OTHER PUBLICATIONS

U.S. Appl. No. 14/635,022, filed Mar. 2, 2015, never published.
Chinese Office Action for Chinese Patent Application No. 201510714343.9 mailed on Oct. 31, 2016.

*Primary Examiner* — Shelby Fidler
(74) *Attorney, Agent, or Firm* — Amin, Turocy & Watson LLP

(57) ABSTRACT

According to an embodiment, an ink jet head includes a discharge unit, a first storing unit, a second storing unit, a waveform generating unit, and a voltage applying unit. The discharge unit discharges ink according to the operation of an actuator. The first storing unit stores a pattern of a voltage to be applied to the actuator. The second storing unit stores a plurality of timer sets. The waveform generating unit generates, on the basis of the timer sets stored by the second storing unit and the voltage pattern stored by the first storing unit, a waveform of the voltage to be applied to the actuator. The voltage applying unit applies the voltage to the actuator on the basis of the waveform generated by the waveform generating unit.

2 Claims, 12 Drawing Sheets

| NUMBER-TH DROP | TIMER SET |
|---|---|
| 1 | TIMER SET Ta |
| 2 | TIMER SET Tb |
| 3 | TIMER SET Tc |
| 4 | |
| 5 | |
| 6 | |
| 7 | |

(56) References Cited

U.S. PATENT DOCUMENTS

| | | | | |
|---|---|---|---|---|
| 2010/0103212 | A1* | 4/2010 | Tabata | B41J 2/04548 347/10 |
| 2014/0160194 | A1 | 6/2014 | Ono et al. | |
| 2014/0160195 | A1 | 6/2014 | Ono et al. | |
| 2014/0176627 | A1 | 6/2014 | Ono et al. | |
| 2015/0054872 | A1 | 2/2015 | Hiyoshi et al. | |
| 2015/0328887 | A1 | 11/2015 | Nitta et al. | |

* cited by examiner

FIG. 6A

| | |
|---|---|
| TIMER SET Ta | t0a, t1a, t2a, ··· t10a |
| TIMER SET Tb | t0b, t1b, t2b, ··· t10b |
| TIMER SET Tc | t0c, t1c, t2c, ··· t10c |
| TIMER SET Td | t0d, t1d, t2d, ··· t10d |

FIG. 6B

| | |
|---|---|
| TIMER SET Ta | t0a, t1a, ··· t9a, tdp |
| TIMER SET Tb | t0b, t1b, ··· t9b, tdp |
| TIMER SET Tc | t0c, t1c, ··· t9c, tdp |
| TIMER SET Td | t0d, t1d, ··· t9d, tdp |

FIG. 7

| NUMBER-TH DROP | TIMER SET |
|---|---|
| 1 | TIMER SET Ta |
| 2 | TIMER SET Tb |
| 3 | TIMER SET Tc |
| 4 | |
| 5 | |
| 6 | |
| 7 | |

FIG. 8

| PRINTING DATA | DROP SEQUENCE | NUMBER OF DROPS |
|---|---|---|
| 0000000 | 0000000 | 0 |
| 1000000 | 1000000 | 1 |
| 1100000 | 1100000 | 2 |
| 1110000 | 1110000 | 3 |
| ⋮ | ⋮ | ⋮ |
| 1111111 | 1111111 | 7 |

FIG. 9

| PRINTING DATA | DROP SEQUENCE | NUMBER OF DROPS |
|---|---|---|
| 00000000 | 00000000 | 0 |
| 11000000 | 11000000 | 1 |
| 11100000 | 11100000 | 2 |
| 11110000 | 11110000 | 3 |
| ⋮ | ⋮ | ⋮ |
| 11111111 | 11111111 | 7 |

FIG. 10

| PRINTING DATA | DROP SEQUENCE | NUMBER OF DROPS |
|---|---|---|
| 000 | 0000000 | 0 |
| 001 | 1000000 | 1 |
| 010 | 1100000 | 2 |
| 011 | 1110000 | 3 |
| ⋮ | ⋮ | ⋮ |
| 111 | 1111111 | 7 |

INK JET HEAD AND PRINTING APPARATUS

CROSS-REFERENCE TO RELATED APPLICATION

This application is based upon and claims the benefit of priority from Japanese Patent Application No. 2014-223402, filed Oct. 31, 2014, the entire contents of which are incorporated herein by reference.

FIELD

Embodiments described herein relate generally to an ink jet head and a printing apparatus.

BACKGROUND

Some printing apparatus drops ink onto a sheet once or a plurality of times on the basis of printing data and the like and forms an image. If the printing apparatus drops the ink a plurality of times, the viscosity of the ink changes because of thixotropy and the like of the ink. The discharge speeds, the volumes, and the like of respective drops change. Therefore, the printing quality of the printing apparatus is unstable.

An example of the related art is described in JP-A-2005-153378.

DESCRIPTION OF THE DRAWINGS

FIGS. 6A and 6B are diagrams showing configuration examples of timer sets according to the embodiment;

FIG. 7 shows an example of a timer set selection table stored by a timer-set drop application register according to the embodiment;

FIG. 8 is a block diagram showing a configuration example of printing data according to the embodiment;

FIG. 9 is a block diagram showing another configuration example of the printing data;

FIG. 10 is a block diagram showing still another configuration example of the printing data;

DETAILED DESCRIPTION

There is provided an ink jet head and a printing apparatus having stable printing quality.

In general, according to one embodiment, an ink jet head includes a discharge unit, a first storing unit, a second storing unit, a waveform generating unit, and a voltage applying unit. The discharge unit discharges ink according to the operation of an actuator. The first storing unit stores a pattern of a voltage to be applied to the actuator. The second storing unit stores a plurality of timer sets. The waveform generating unit generates, on the basis of the timer sets stored by the second storing unit and the voltage pattern stored by the first storing unit, a waveform of the voltage to be applied to the actuator. The voltage applying unit applies the voltage to the actuator on the basis of the waveform generated by the waveform generating unit.

An embodiment is explained below with reference to the drawings.

In the embodiment, an ink jet head is an ink jet head of a share mode and a shared wall system. However, the ink jet head is not limited to a specific system.

Figure 1:
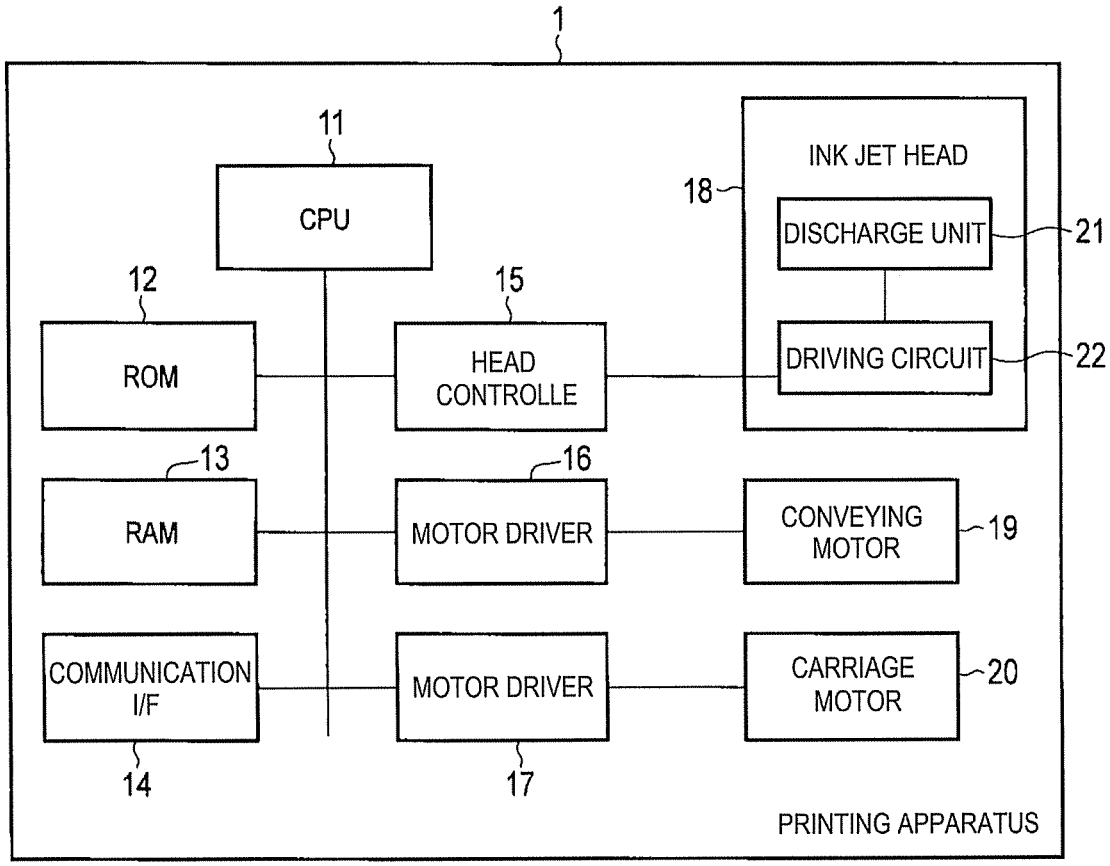
FIG. 1 is a block diagram showing a configuration example of a printing apparatus according to an embodiment.

FIG. 1 is a block diagram showing a configuration example of a printing apparatus according to the embodiment.

In the configuration example shown in FIG. 1, a printing apparatus 1 includes a CPU 11, a ROM 12, a RAM 13, a communication I/F 14, a head controller 15, motor drivers 16 and 17, an ink jet head 18, a conveying motor 19, and a carriage motor 20.

The CPU 11 controls the entire printing apparatus 1. The CPU 11 is a processor that realizes various kinds of processing by executing a computer program. The CPU 11 is connected to the units in the printing apparatus 1 via a system bus or the like. The CPU 11 outputs operation instructions to the units in the printing apparatus 1 and notifies an external apparatus of various kinds of information acquired from the units according to an operation instruction received from the external apparatus.

The ROM 12 is an unrewritable nonvolatile memory that stores a computer program, control data, and the like. The RAM 13 is configured by a volatile memory. The RAM 13 is a working memory or a buffer memory. The CPU 11 realizes various kinds of processing by executing the computer program and the like stored in the ROM 12 while using the RAM 13. Note that the printing apparatus 1 may include a rewritable nonvolatile memory.

The communication I/F 14 is an interface for communicating with the external apparatus. For example, the communication I/F 14 receives print data corresponding to a print request issued by the external apparatus. The communication I/F 14 only has to be an interface that performs transmission and reception of data to and from the external apparatus. For example, the communication I/F 14 may be an interface locally connected to the external apparatus or may be a network interface for communicating via a network.

The head controller 15 drives the ink jet head 18 on the basis of an instruction received from the CPU 11. The head controller 15 is electrically connected to a driving circuit 22 of the ink jet head 18. The CPU 11 transmits printing data, a control signal, and the like to the driving circuit 22 via the head controller 15. The control signal may include a shift clock signal, a latch pulse signal, and a timing pulse signal. The head controller 15 may supply electric power, a clock, a reset signal, and the like to the driving circuit 22.

The motor driver 16 drives the conveying motor 19 on the basis of an instruction received from the CPU 11. The motor driver 17 drives the carriage motor 20 on the basis of an instruction received from the CPU 11.

The conveying motor 19 drives, on the basis of an instruction received from the motor driver 16, a roller that conveys a printing medium used for printing in the printing apparatus 1. For example, the conveying motor 19 drives a pickup roller, a conveying roller, and the like. The CPU 11 controls the conveying motor 19 through the motor driver 16 to feed the printing medium to a position where the ink jet head 18 discharges ink.

The carriage motor 20 drives, on the basis of an instruction received from the motor driver 17, a roller connected to a carriage including the ink jet head 18. The CPU 11 controls the carriage motor 20 through the motor driver 17 to dispose the ink jet head 18 in a predetermined position.

The ink jet head 18 discharges the ink to the printing medium on the basis of an instruction received from the head controller 15. That is, the CPU 11 causes, through the head controller 15, the ink jet head 18 to discharge the ink. The ink jet head 18 includes a discharge unit 21 and the driving circuit 22.

The discharge unit 21 discharges the ink to the printing medium on the basis of a signal or the like received from the driving circuit 22. The discharge unit 21 fills the ink in a pressure chamber and discharges the filled ink to the printing medium according to a voltage applied by the driving circuit 22.

The conveying motor may be configured to feed the printing medium at constant speed perpendicularly to a nozzle arrangement direction of the ink jet head and drive the fixed ink jet head to perform printing. Conversely, the conveying motor may be configured to move, in a state in which the printing medium stands still, the carriage motor at constant speed perpendicularly to the nozzle arrangement direction of the ink jet head to perform printing. The conveying motor may be configured to drive the ink jet head to deposit the ink on the medium in a state in which both of the conveying motor and the carriage motor are stopped and subsequently slightly move one of the conveying motor and the carriage motor and then perform printing in another position.

Each of the conveying motor and the carriage motor may have one axis or may have two axes. The axes the conveying motor and the carriage motor are orthogonal to each other. Alternatively, only one of the conveying motor and the carriage motor may be provided.

The printing medium is, for example, a sheet but is not limited to a specific medium. The printing medium may be a three-dimensional structure. The printing apparatus 1 may be a printing apparatus that directly performs printing on the three-dimensional object or directly forms the three-dimensional structure through printing. Alternatively, the printing medium may include a dispensing groove. The printing apparatus 1 may be a printing apparatus that dispenses the ink into the groove. The printing apparatus 1 does not have to include the motor driver 16, the motor driver 17, the conveying motor 19, and the carriage motor 20. In this case, the printing apparatus 1 may print an image on a fixed printing medium or a printing medium conveyed by another apparatus.

Figure 2:
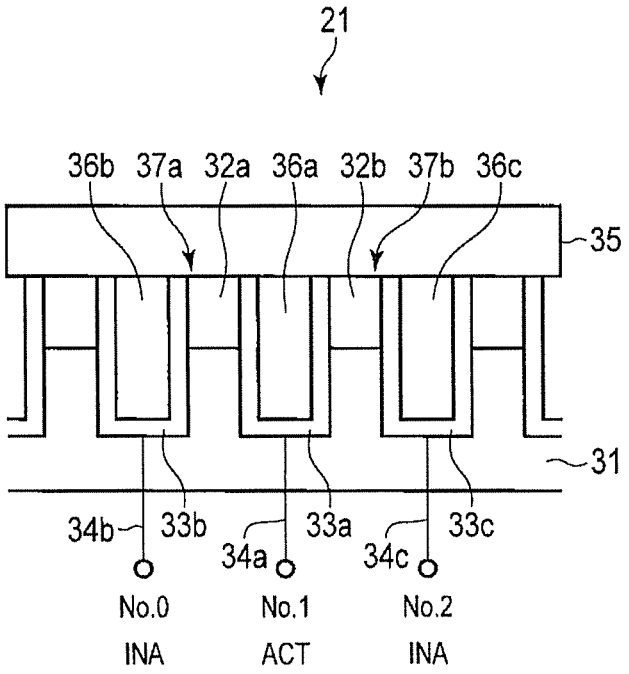
FIG. 2 is a sectional view schematically showing a discharge unit according to the embodiment.

FIG. 2 is a sectional view schematically showing the discharge unit 21.

As shown in FIG. 2, the discharge unit 21 includes a first piezoelectric member 31, second piezoelectric members 32*a* and 32*b*, electrodes 33*a* to 33*c*, leads 34*a* to 34*c*, and a top plate 35.

In the discharge unit 21, the first piezoelectric member 31 is joined to the top surface of a not-shown base substrate and the second piezoelectric members 32 are joined on the first piezoelectric member 31. The first piezoelectric member 31 and the second piezoelectric members 32 are polarized in directions opposite to each other along a plate thickness direction and joined. A large number of long grooves are provided from one end to the other end of the joined first and second piezoelectric members 31 and 32 in the discharge unit 21. The grooves are disposed at a fixed interval and parallel to one another.

The first piezoelectric member 31 and the second piezoelectric member 32*a* form an actuator 37*a*. Similarly, the first piezoelectric member 31 and the second piezoelectric member 32*b* form an actuator 37*b*. A voltage is applied to the actuators 37*a* and 37*b* from the driving circuit 22 through the electrodes 33. If the voltage is applied, the actuators 37*a* and 37*b* change the volume in a pressure chamber 36*a*.

In the discharge unit 21, the electrodes 33*a* to 33*c* are provided on the sidewalls and the bottom surfaces of the grooves. The leads 34*a* to 34*c* extended from the electrodes 33*a* to 33*c* are provided from the insides to the outsides of the grooves.

In the discharge unit 21, the top plate 35 is provided on the grooves. The top plate 35 and the electrode 33*a* form the pressure chamber 36*a* on the inside. Similarly, the top plate 35 and the electrode 33*b* form a pressure chamber 36*b* on the inside. The top plate 35 and the electrode 33*c* form a pressure chamber 36*c* on the inside.

In order to fill the ink, the pressure chambers 36 communicate with a supply port for receiving supply of the ink from a not-shown ink tank. The pressure chambers 36 communicate with a discharge port for discharging the ink.

The electrode 33*a* and the electrode 33*b* apply a voltage to the actuator 37*a*. That is, a difference between a voltage applied to the electrode 33*a* and a voltage applied to the electrode 33*b* is applied to the actuator 37*a*. Similarly, the electrode 33*a* and the electrode 33*c* apply a voltage to the actuator 37*b*.

In an example shown in FIG. 2, channels No. 0 to No. 2 for discharging the ink are shown. However, the discharge unit 21 may include a larger number of channels.

The discharge unit 21 drives the two actuators 37 and the three electrodes 33 and discharges the ink to the printing medium from nozzles provided in one pressure chambers 36. For example, if the ink is discharged from the channel No. 1, the discharge unit 21 drives the actuators 37*a* and 37*b* and discharges the ink to the printing medium from a nozzle provided in the pressure chamber 36*a*. If the ink is discharged from a certain channel, the ink cannot be simultaneously discharged from channels on both sides of the channel. For example, if the ink is discharged from the channel No. 1, the discharge unit 21 cannot discharge the ink from the channels No. 0 and No. 2.

The discharge unit 21 can discharge the ink from any channel among all the channels by performing the discharge operation three times while shifting the channels one by one.

The discharge unit 21 can continuously discharge the ink from the channel a plurality of times. For example, on the basis of an instruction received from the driving circuit 22, the discharge unit 21 discharges the ink a large number of times to a portion to be printed thick and discharges the ink once or a small number of times to a portion to be printed thin. The discharge unit 21 can adjust color depth by controlling the number of times the discharge unit 21 discharges the ink. The discharge unit 21 can continuously discharge the ink seven times from the channel. Note that the number of times the discharge unit 21 can continuously discharge the ink is not limited to a specific number of times.

Figure 3:
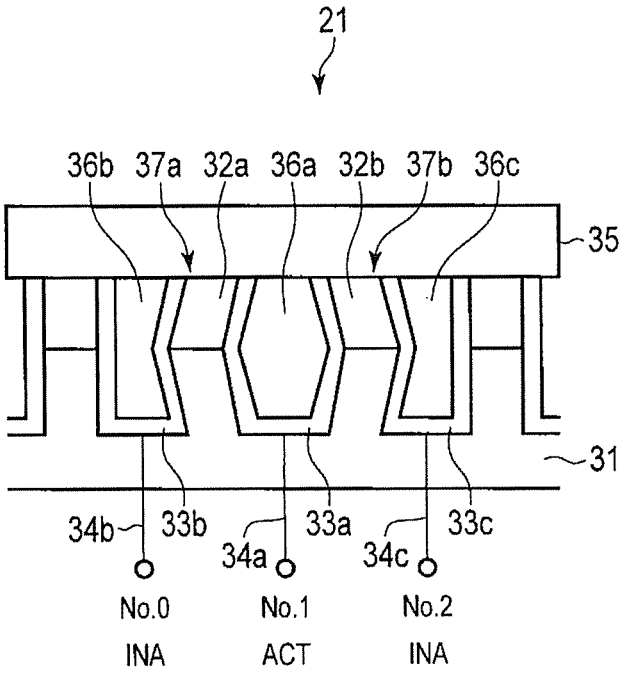
FIG. 3 is a sectional view showing the discharge unit in a Pull state.

FIG. 3 is a sectional view schematically showing the discharge unit 21 that is in an ink filled state (a Pull state).

In an example shown in FIG. 3, a dischargeable channel is the channel No. 1.

The driving circuit 22 applies a voltage to the actuators 37*a* and 37*b* through the electrodes 33*a* to 33*c* to fill the ink and drives the actuators. As a result, the actuators 37*a* and 37*b* are deformed as shown in FIG. 3.

As shown in FIG. 3, the actuator 37*a* is bent into the pressure chamber 36*b* of the channel No. 0, which is a channel adjacent to the actuator 37*a*. Similarly, the actuator 37*b* is bent into the pressure chamber 36*c* of the channel No. 2, which is a channel adjacent to the actuator 37*b*.

As a result, the volume in the pressure chamber 36*a* increases from the volume in a release state (a state shown in FIG. 2). The ink is filled in the pressure chamber 36*a* from an ink supply port.

If the discharge unit 21 returns from the Pull state to the release state, the volume in the pressure chamber 36*a* is about to return to the original state. Consequently, the discharge unit 21 discharges the ink to the printing medium from a discharge port corresponding to the channel No. 1.

Figure 4:
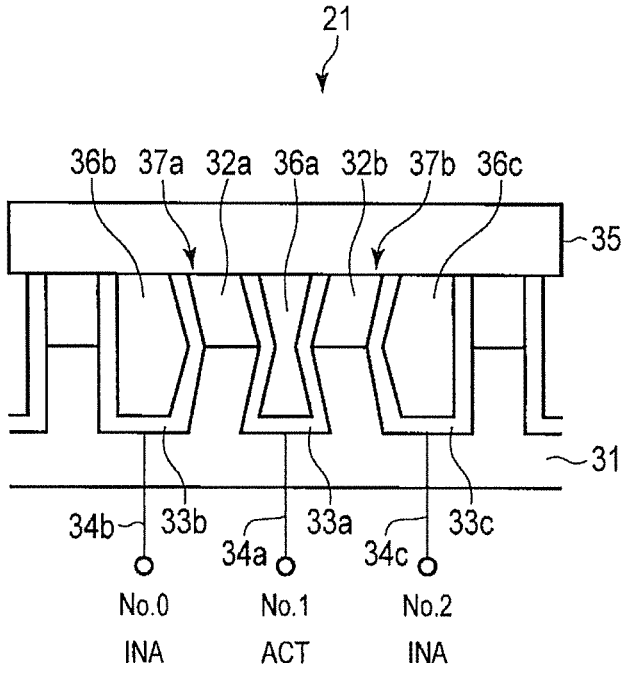
FIG. 4 is a sectional view showing the discharge unit in a cancel state.

FIG. 4 is a sectional view schematically showing the discharge unit 21 in a cancel state.

After an appropriate time elapses from the discharge, the discharge unit 21 changes the actuators 37 to the cancel state in order to cancel vibration that occurs in the actuators 37 and the like because of the discharge.

The driving circuit 22 applies a voltage to the actuators 37*a* and 37*b* through the electrodes 33*a* to 33*c* to change the actuators 37*a* and 37*b* to the cancel state and drives the actuators. As a result, the actuators 37*a* and 37*b* are deformed as shown in FIG. 4.

As shown in FIG. 4, the actuator 37*a* is bent into the pressure chamber 36*a*. Similarly, the actuator 37*b* is bent into the pressure chamber 36*a*. That is, the volume in the pressure chamber 36*a* decreases from the volume in the release state (the state shown in FIG. 2). After the cancel state is maintained for a while and an appropriate time elapses, the voltage to be applied to the actuators 37*a* and 37*b* is returned to zero. As a result, the actuators 37*a* and 37*b* return to the state shown in FIG. 2. In this way, the discharge unit 21 can suppress vibration and the like that occur in the actuators 37 and the like if the ink is discharged.

The driving circuit 22 is explained.

The driving circuit 22 causes the discharge unit 21 to discharge the ink on the basis of an instruction received from the head controller 15. The driving circuit 22 applies a voltage to the electrodes 33 of the discharge unit 21 to drive the actuators 37 of the discharge unit 21 and deform the actuators 37. The driving circuit 22 drives the actuators 37 to cause the discharge unit 21 to fill the ink and discharge the ink to the printing medium. The driving circuit 22 is electrically connected to the electrodes 33 of the channels of the discharge unit 21. The driving circuit 22 is configured from, for example, an IC.

Figure 5:
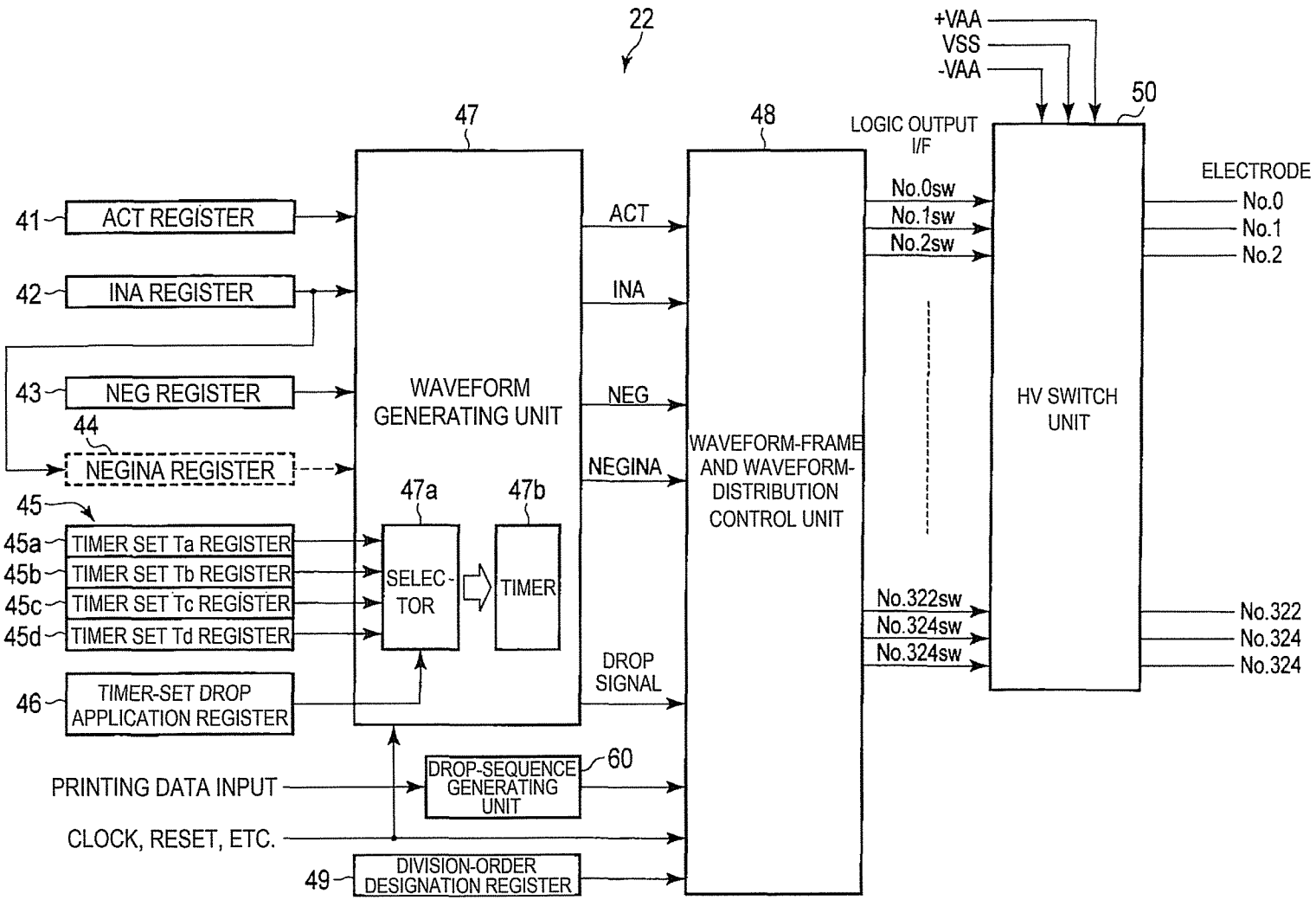
FIG. 5 is a block diagram showing a configuration example of a driving circuit according to the embodiment.

FIG. 5 is a block diagram showing a configuration example of the driving circuit 22.

As shown in FIG. 5, the driving circuit 22 includes an ACT register 41, an INA register 42, an NEG register 43, an NEGINA register 44, a timer set register 45, a timer-set drop application register 46, a waveform generating unit 47, a waveform-frame and waveform-distribution control unit 48, a division-order designation register 49, an HV switch unit 50, and a drop-sequence generating unit 60.

If the ink is discharged from the dischargeable channel (in FIG. 2, the channel No. 1), the ACT register 41 stores information (a pattern) indicating change point of a waveform of a voltage (an ACT voltage) to be applied to electrodes (target electrodes) of the channel. That is, the ACT register 41 determines the change point of the waveform of the ACT voltage. The ACT register 41 stores voltage information indicating voltages to be applied in periods of the waveform. For example, the ACT register 41 stores "+", "VSS", or "−" as the voltage information corresponding to the periods of the ACT voltage. "+" indicates that +VAA is applied to the target electrodes. "VSS" indicates that 0 V is applied to the target electrodes. "−" indicates that −VAA is applied to the target electrodes. −" indicates that −VAA is applied to the target electrodes.

For example, the ACT register 41 stores "VSS, −, −, +". In this example, the ACT register 41 applies 0 V to the target electrodes in a first period of the ACT voltage, applies −VAA to the target electrodes in a second period and a third period, and applies +VAA to the target electrodes in a fourth period. The pattern stored by the ACT register 41 is not limited to a specific configuration.

The number of elements stored by the ACT register 41 is determined according to the number of waveform elements of the ACT voltage. Note that the ACT register 41 may be a fixed register in which a pattern is written during manufacturing or the like or may be a rewritable register. In the latter case, a value of the timer set register 45 may be stored by initial setting from the CPU 11 or may be stored or changed at any timing by the CPU 11.

When the ink is discharged from the dischargeable channel, the INA register 42 stores a pattern of a voltage (an INA voltage) to be applied to electrodes (adjacent electrodes) of channels (in FIG. 2, the channels No. 0 and No. 2) adjacent to the dischargeable channel.

The NEG register 43 stores a pattern of a voltage (an NEG voltage) to be applied to the target electrodes when the ink is not discharged from the dischargeable channel.

The NEGINA register 44 stores a pattern of a voltage (an NEGINA voltage) applied to the adjacent electrodes if the ink is not discharged from the dischargeable channel. Note that the NEGINA register 44 may be substituted by the INA register 42.

The configurations of the INA register 42, the NEG register 43, and the NEGINA register 44 are the same as the configuration of the ACT register 41. Therefore, explanation of the configurations is omitted.

As explained above, the registers explained above have stored therein voltage patterns to be applied to the electrodes of the actuators.

On the other hand, the timer set register 45 stores time intervals (timer sets) of the periods of the pattern of the voltage. The timer sets are configured from time information indicating the time intervals of the periods. The number of kinds of the time information stored by the timer sets may be the same as or may be different from the number of periods into which the voltage pattern is divided. The timer set register 45 may further store a discontinuation time tdp when the waveform generating unit 47 discontinues the generation of the waveform of the voltage.

Note that the timer set register 45 may be stored in advance as an unrewritable fixed register provided in the driving circuit 22. Alternatively, the timer set register 45 may be a rewritable register provided in the driving circuit 22. In the latter case, a value of the timer set register 45 may be stored by initial setting from the CPU 11 or may be stored or changed at any timing by the CPU 11.

In the example shown in FIG. 5, the timer set register 45 is configured from a timer set Ta register 45*a*, a timer set Tb register 45*b*, a timer set Tc register 45*c*, and a timer set Td register 45*d*.

The timer set Ta register 45*a* stores a timer set Ta.

The timer set Tb register 45*b* stores a timer set Tb different from the timer set Ta. The timer set Tc register 45*c* stores a timer set Tc different from the timer sets Ta and Tb. The timer set Td register 45*d* stores a timer set Td different from the timer sets Ta to Tc.

FIGS. 6A and 6B are diagrams showing configuration examples of the timer sets Ta to Td.

In a certain embodiment, as shown in FIG. 6A, the timer sets store t0 to t10 as time information. The time information of the timer sets indicates the time intervals. The order of the time information corresponds to the periods.

For example, the timer set Ta register 45*a* stores "t0*a*, t1*a*, t2*a*, t3*a*, . . . " as the timer set Ta. The timer set Ta register 45*a* indicates that, for example, the first period is "t0*a*".

In another embodiment, as shown in FIG. 6B, the timer sets store time information indicating the time intervals and the discontinuation time tdp when the waveform generating unit 47 discontinues the generation of the waveform of the voltage. The time information is the same as the time information shown in FIG. 6A.

The discontinuation time tdp may be longer than or shorter than a total of the time intervals indicated by the time information corresponding to the discontinuation time tdp. If the discontinuation time tdp is longer than the total of the time intervals, after a time interval indicated by the last time information elapses, 0 V is applied to both of the electrodes of the target channel and the electrodes of the adjacent channels.

The timer sets may store discontinuation times tdp different from one another or may store the same discontinuation time tdp.

If the timer sets store the discontinuation time tdp, the waveform generating unit 47 discontinues generation of a waveform for a discharge operation for one ink droplet in the discontinuation time tdp stored by the timer sets.

Note that the timer set register 45 may simultaneously store the timer sets including the discontinuation time tdp and the timer sets not including the discontinuation time tdp.

The timer-set drop application register 46 transmits a selection signal designating a timer set to be selected by a selector 47*a* in every number-th drop to the selector 47*a*. The selection signal indicates the timer set to be selected by the selector 47*a*. That is, the selector 47*a* selects the timer set on the basis of the selection signal transmitted by the timer-set drop application register 46.

The timer-set drop application register 46 may transmit the selection signal every time the waveform-frame and waveform-distribution control unit 48 generates one waveform or may collectively transmit selection signals corresponding to number-th drops.

FIG. 7 shows an example of a timer set selection table stored by the timer-set drop application register 46. The timer set selection table stores number-th drops and the timer sets in association with each other.

The timer-set drop application register 46 transmits the selection signal to the selector 47*a* on the basis of the timer set selection table. That is, the timer-set drop application register 46 transmits a selection signal for selecting a timer set corresponding to a number-th drop to the selector 47*a*.

For example, the timer-set drop application register 46 transmits a selection signal for causing the selector 47*a* to select the timer set Ta as a timer set of a first drop to the selector 47*a*.

Note that, every time the waveform generating unit 47 generates a waveform corresponding to a drop, the timer-set drop application register 46 may transmit a selection signal corresponding to the next number-th drop to the selector 47*a*. The timer-set drop application register 46 may collectively transmits selection signals corresponding to drops to the selector 47*a* before the waveform generating unit 47 generates a waveform corresponding to a drop.

The waveform generating unit 47 generates a waveform of a voltage to be applied to the discharge unit 21 on the basis of the selection signals transmitted by the ACT register 41, the INA register 42, the NEG register 43, the NEGINA register 44, the timer-set Ta register 45*a*, the timer-set Tb register 45*b*, the timer-set Tc register 45*c*, the timer-et Td register 45*d*, and the timer-set drop application register 46. The waveform generating unit 47 generates the waveform of the voltage by combining a pattern and a timer set.

For example, when generating a waveform of an ACT voltage, the waveform generating unit 47 combines the pattern stored by the ACT register 41 and a timer set (e.g., the timer set Ta) to generates the waveform of the ACT voltage. In this case, the waveform generating unit 47 sets time in the first period of the waveform of the voltage as "t0*a*" on the basis of the timer set Ta. The waveform generating unit 47 sets a voltage in the first period of the ACT voltage as "VSS" on the basis of the information stored in the ACT register 41. The waveform generating unit 47 performs the same operation in all the periods and generates the waveform of the ACT voltage.

As shown in FIG. 5, the waveform generating unit 47 includes a selector 47*a* and a timer 47*b*.

The selector 47*a* selects a timer set used for generating a waveform of a voltage from a plurality of timer sets (in FIG. 5, the timer sets Ta to Td). The selector 47*a* selects a timer set for each drop. For example, the selector 47*a* selects the timer set Ta for the first drop and selects the timer set Tb for the second drop.

The selector 47*a* may select a timer set such that volumes of all the drops are fixed. The selector 47*a* may select a timer set such that discharge speeds of all the drops are fixed. The selector 47*a* may select a timer set to change a discharge volume or discharge speed for each drop.

A method of the selector 47*a* selecting a timer set is not limited to a specific method.

The selector 47*a* transmits the selected timer set to the timer 47*b*.

The timer 47*b* sets lengths of the periods of the voltage on the basis of the timer set selected by the selector 47*a*. The timer 47*b* notifies the waveform generating unit 47 of ends of the periods by, for example, transmitting signals at the ends of the periods.

If the timer set selected by the selector 47*a* stores the discontinuation time tdp, the timer 47*b* sets the discontinuation time tdp. For example, the timer 47*b* measures time after a discharge operation is started. If the measured time reaches the discontinuous time tdp, by, for example, transmitting a signal, the timer 47*b* notifies the waveform generating unit 47 that the discontinuous time elapses.

The waveform generating unit 47 generates a waveform of the voltage on the basis of the lengths of the periods set by the timer 47*b* and the pattern of the voltage and transmits the generated waveform to the waveform-frame and waveform-distribution control unit 48.

For example, when generating a waveform of an ACT voltage, the waveform generating unit 47 acquires information indicating a voltage in the first period from the ACT register 41. If the information indicating the voltage in the first period is acquired, the waveform generating unit 47 transmits an instruction for applying the voltage indicated by the information to the waveform-frame and waveform-distribution control unit 48. If the timer 47*b* notifies the end of the first period, the waveform generating unit 47 acquires information indicating a voltage in the second period. If the information indicating the voltage in the second period is acquired, the waveform generating unit 47 transmits an instruction for applying the voltage indicated by the information to the waveform-frame and waveform-distribution control unit 48. The waveform generating unit 47 performs the same operation in all the periods and generates the waveform of the ACT voltage.

The waveform generating unit 47 generates a waveform of an INA voltage, a waveform of an NEG voltage, and a waveform of an NEGINA voltage by performing the same operation.

In the same number-th drop, the waveform generating unit 47 applies the same timer set to the waveforms of all the voltages. For example, in the first drop, the waveform generating unit 47 applies the timer set Ta to the waveforms of all the voltages. In the second drop, the waveform generating unit 47 applies the timer set Tb to the waveforms of all the voltages.

The waveform-frame and waveform-distribution control unit 48 generates switch signals for applying voltages to the electrodes of the channels. As a switch signal for a group (a target division) of simultaneously dischargeable channels, the waveform-frame and waveform-distribution control unit 48 generates a switch signal for applying the ACT voltage or the NEG voltage. As a switch signal for groups (adjacent divisions) of un-dischargeable channels, the waveform-frame and waveform-distribution control unit 48 generates a switch signal for applying the INA voltage or the NEGINA voltage.

The division-order designation register 49 stores order for setting a dischargeable group. The waveform-frame and waveform-distribution control unit 48 and the division-order designation register 49 are explained below in detail.

The HV switch unit 50 applies voltages to the actuators 37 of the channels on the basis of the switch signals received from the waveform-frame and waveform-distribution control unit 48.

The HV switch unit 50 is explained in detail below.

The drop-sequence generating unit 60 generates a drop sequence on the basis of printing data transmitted by the CPU 11 through the head controller 15.

The printing data designates the number of times or timing of discharge of the ink for each channel. The printing data may indicate the number of times and the timing the discharge of the ink by the channel as a 1/0 signal (a binary signal) or may indicate the number of times and the timing as code data (e.g., encoded data indicating the number of drops).

The drop sequence indicates the number of times and the timing of the discharge of the ink by the channel as a 1/0 signal (a binary signal). For example, "1" indicates that the ink is discharged and "0" indicates that the ink is not discharged. The drop sequence stores 1/0 signals as many as the number of times the channel can continuously discharge the ink.

The drop-sequence generating unit 60 transmits the generated drop sequence to the waveform-frame and waveform-distribution control unit 48.

FIG. 8 shows a configuration example of the printing data, the drop sequence, and the number of drops.

The printing data designates the number of times or timing of discharge of the ink for each channel. The channels can continuously discharge the ink seven times. Therefore, the printing data stores seven bits.

In this case, the drop-sequence generating unit 60 directly transmits the printing data to the waveform-frame and waveform-distribution control unit 48 as the drop sequence.

It is possible to select timing of discharge of the ink by changing a position where a bit "1" is set in the printing data. For example, if the channel discharges the ink twice, the CPU 11 may generate "1010000", "011000", "0000011", and the like.

FIG. 9 shows another configuration example of the printing data, the drop sequence, and the number of drops.

The printing data shown in FIG. 9 is printing data transmitted if the channel cannot discharge the first drop because of the influence due to hysteresis of the actuators 37, the influence due to, for example, thixotropy of the ink, or the like. As shown in FIG. 9, in the printing data, "1" is added in the beginning of a bit string including "1". Since "1" is added, the channel can discharge the ink an appropriate number of times.

FIG. 10 shows still another configuration example of the printing data, the drop sequence, and the number of drops.

As shown in FIG. 10, the printing data is code data indicating the number of times of discharge as a binary number.

In this case, the drop-sequence generating unit 60 determines timing of discharge of the ink. For example, the drop-sequence generating unit 60 may determine timing to discharge the ink in the front, in the middle, or in the back. The drop-sequence generating unit 60 determines timing of discharge of the ink on the basis of a command of an external apparatus (the CPU 11, etc.)

In the example shown in FIG. 10, the drop-sequence generating unit 60 determines the timing of discharge of the ink in the front. If the ink is discharged in the back, the drop-sequence generating unit 60 may be configured to generate, for example, an inverted sequence such as "0000011" instead of "1100000" as a drop sequence of printing data "010".

Figure 11:
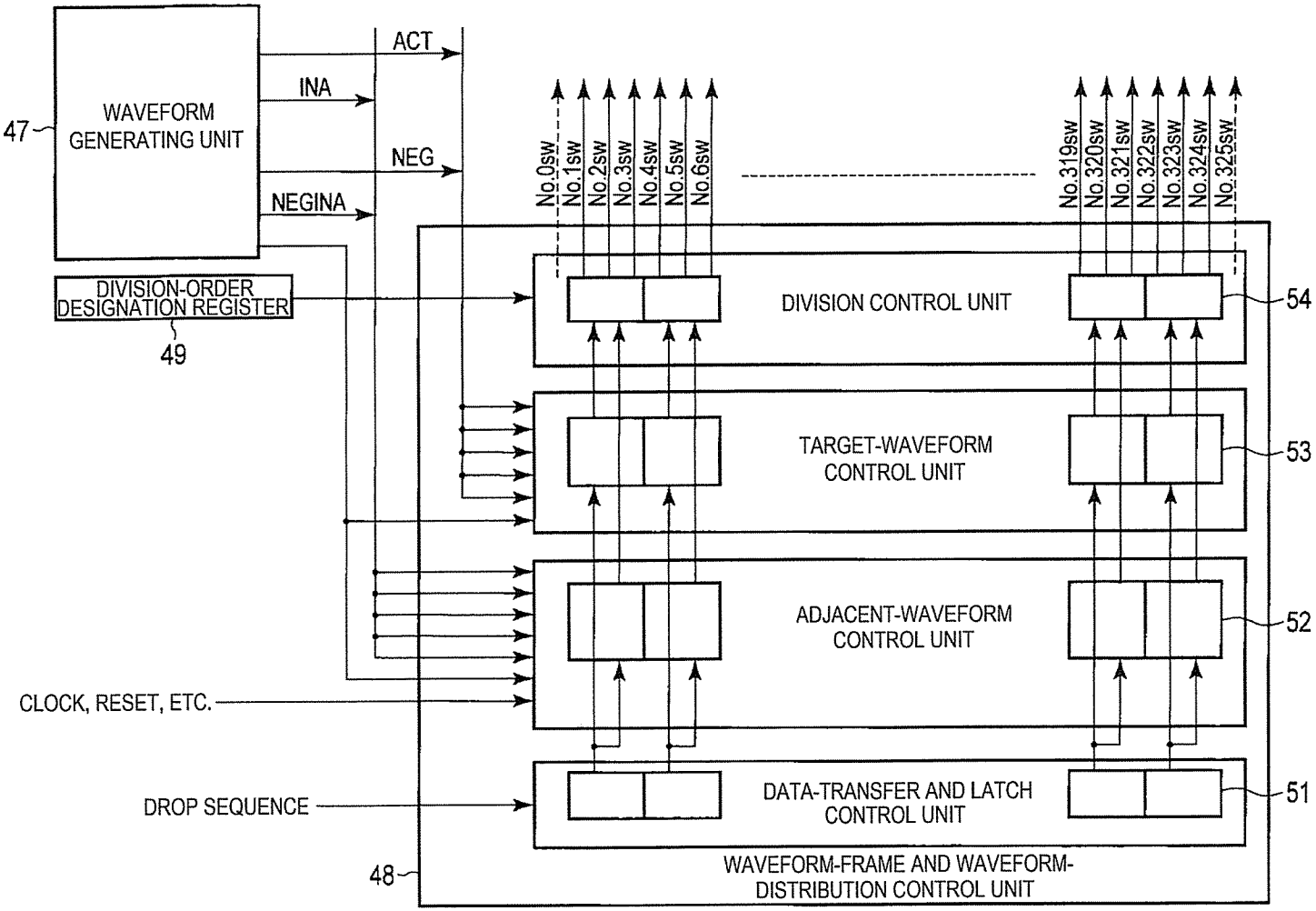
FIG. 11 is a block diagram showing a configuration example of a waveform-frame and waveform-distribution control unit according to the embodiment.

FIG. 11 is a block diagram showing a configuration example of the waveform-frame and waveform-distribution control unit 48.

As shown in FIG. 11, the waveform-frame and waveform-distribution control unit 48 includes a data-transfer and latch control unit 51, an adjacent-waveform control unit 52, a target-waveform control unit 53, and a division control unit 54. The data-transfer and latch control unit 51 transmits, on the basis of the drop sequence, timing of discharge of the ink by the channels to the adjacent-waveform control unit 52 and the target-waveform control unit 53.

The adjacent-waveform control unit 52 sets, on the basis of the timing of discharge of the ink by the channels, a waveform of a voltage to be applied to the electrodes 33 of the channels (the adjacent channels) adjacent to the dischargeable channel (the target channel). For example, the adjacent-waveform control unit 52 sets a waveform of the INA voltage or a waveform of the NEGINA voltage as the waveform of the voltage to be applied to the adjacent channels. If the target channel discharges the ink, the adjacent-waveform control unit 52 sets the waveform of the INA voltage as the waveform of the voltage to be applied to the adjacent channels adjacent to the target channel. If the target channel does not discharge the ink, the adjacent-waveform control unit 52 sets the waveform of the NEGINA voltage as the waveform of the voltage to be applied to the adjacent channels adjacent to the target channel.

The target-waveform control unit 53 sets, on the basis of the timing of the discharge of the ink by the channels, a waveform of a voltage to be applied to the electrodes 33 of the dischargeable channel. For example, the target-waveform control unit 53 sets a waveform of the ACT voltage or a waveform of the NEG voltage as the waveform of the voltage to be applied to the target channel. If the target channel discharges the ink, the target-waveform control unit 53 sets a waveform of the ACT voltage as the waveform of the voltage to be applied to the target channel. If the target channel does not discharge the ink, the target-waveform control unit 53 sets a waveform of the NEG voltage as the waveform of the voltage to be applied to the target channel.

The division control unit 54 sets, on the basis of division order stored by the division-order designation register 55, a group (a target division) of the target channel and groups (adjacent divisions) of the adjacent channels. The division control unit 54 transmits a switch signal based on the waveform set by the target-waveform control unit 53 to the HV switch unit 50 as a switch signal corresponding to the channel of the target division. The division control unit 54 transmits a switch signal based on the waveform set by the adjacent-waveform control unit 52 to the HV switch unit 50 as a switch signal corresponding to the channels of the adjacent divisions.

The division-order designation register 55 stores order for setting a dischargeable group. For example, the division-order designation register 55 may store information indicating that a group of channels of No. 3n+1 (n is a natural number including 0) is set as the target division first, a group of channels of No. 3n+2 is set as the target division next, and a group of channels of No. 3n+3 is set as the target division last.

In this example, first, the division control unit 54 sets the group of the channels of No. 3n+1 as the target division. At this point, the division control unit 54 sets the groups of the channels of No. 3n+2 and No. 3n+3 as the adjacent divisions.

If the discharge operation of the target division ends, the division control unit 54 sets the group of the channels of No. 3n+2 as the target division. At this point, the division control unit 54 sets the groups of the channels of No. 3n+1 and No. 3n+3 as the adjacent divisions.

If the discharge operation of the target division ends, the division control unit 54 sets the group of the channels of No. 3n+3 as the target division. At this point, the division control unit 54 sets the groups of the channels of No. 3n+1 and No. 3n+2 as the adjacent divisions.

According to the operation explained above, the division control unit 54 can cause all the channels to discharge the ink.

Figure 12:
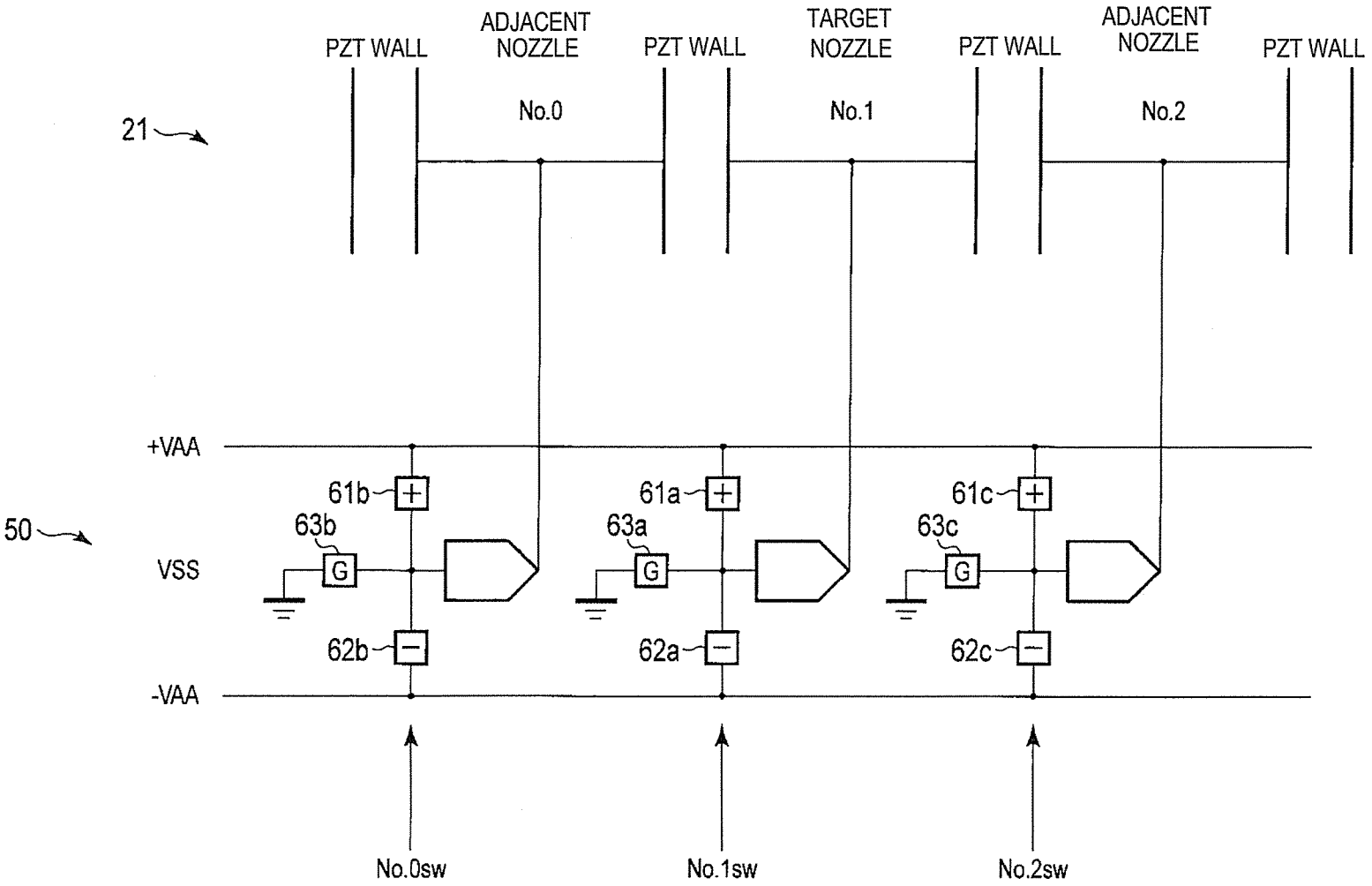
FIG. 12 is a diagram schematically showing a configuration example of an HV switch unit and a discharge unit according to the embodiment.

FIG. 12 is a block diagram showing a configuration example of the RV switch unit 50 (the voltage applying unit).

As shown in FIG. 12, the HV switch unit 50 includes +VAA switches 61, −VAA switches 62, and VSS switches 63.

The +VAA switches 61 are switches that connect +VAA and the electrodes 33 of the channels.

The −VAA switches 62 are switches that connect −VAA and the electrodes 33 of the channels.

The VSS switches 63 are switches that connect VSS (the ground) and the electrodes 33 of the channels.

The switches operate exclusively one another. That is, while one switch is connected to the electrodes 33, the other switches are not connected to the electrodes 33.

For example, the +VAA switches 61, the −VAA switches 62, and the VSS switches 63 are configured by MOS transistors or the like.

In the embodiment, +VAA is +7 V to +18 V. −VAA is −7 V to −18 V. Note that +VAA and −VAA are not limited to specific voltages.

The HV switch unit 50 includes a +VAA switch 61*b*, a −VAA switch 62*b*, and a VSS switch 63*b* as switches corresponding to a channel of No. 0. The HV switch unit 50 includes a +VAA switch 61*a*, a −VAA switch 62*a*, and a VSS switch 63*a* as switches corresponding to a channel of No. 1. The HV switch unit 50 includes a +VAA switch 61*c*, the −VAA switch 62*c*, and a VSS switch 63*c* as switches corresponding to a channel of No. 2.

For example, if a signal connected to "+VAA" is received as a switch signal of No. 1, the HV switch unit 50 turns off the −VAA switch 62*a* and the VSS switch 63*a* and turns on the +VAA switch 61*a*. According to this operation, the HV switch unit 50 applies +VAA to the electrodes 33 of the channel of No. 1.

A voltage to be applied to the actuators 37 is explained.

Figure 13:
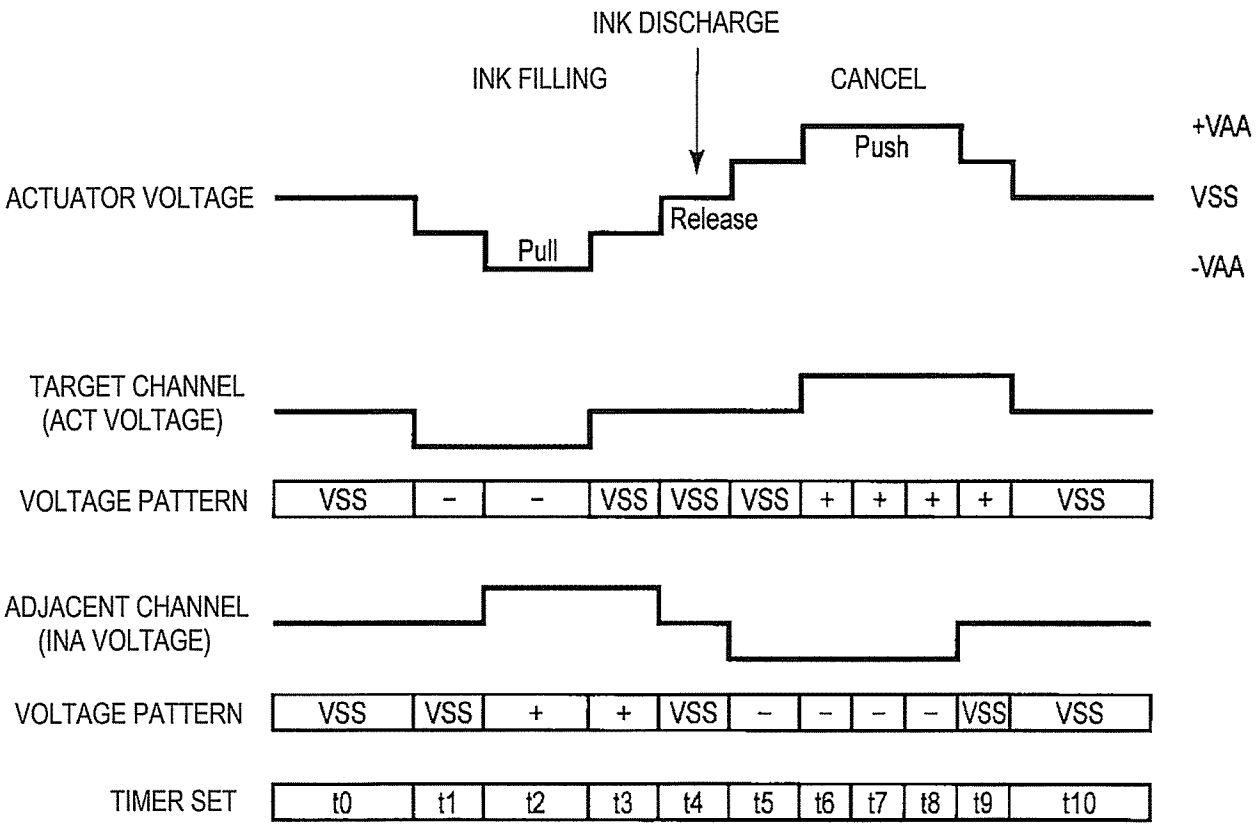
FIG. 13 is a timing chart showing a voltage applied to actuators of the discharge unit.

FIG. 13 is a timing chart showing the voltage to be applied to the actuators 37, the ACT voltage, and the INA voltage.

The timing chart shown in FIG. 13 shows the voltages applied if the target channel discharges the ink once.

The actuator voltage indicates a voltage to be applied to the actuators 37 of the target channel. In the example shown in FIG. 2, if the target channel is the channel of No. 1, the actuator voltage is a voltage to be applied to the actuators 37*a* and 37*b*.

As shown in FIG. 13, first, a predetermined negative voltage is applied to the actuators 37*a* and 37*b*. When the predetermined negative voltage is applied, the actuators 37*a* and 37*b* change to the Pull state shown in FIG. 3. When the actuators 37*a* and 37*b* change to the Pull state, the pressure chamber 36*a* sucks the ink from the ink tank.

After the pressure chamber 36*a* sucks the ink, 0 V is applied to the actuators 37*a* and 37*b*. When 0 V is applied, the actuators 37*a* and 37*b* change to the release state shown in FIG. 2. If the actuators 37*a* and 37*b* change to the release state, the ink is discharged to the printing medium from the pressure chamber 36*a*.

After the ink is discharged to the printing medium from the pressure chamber 36*a*, a predetermined positive voltage is applied to the actuators 37*a* and 37*b*. When the predetermined positive voltage is applied, the actuators 37*a* and 37*b* change to the cancel state shown in FIG. 4. If the actuators 37*a* and 37*b* change to the cancel state, 0 V is applied to the actuators 37*a* and 37*b*. If 0 V is applied, the discharge operation for one drop ends.

The ACT voltage to be applied to the electrode 33*a* is generated by a pattern of the ACT voltage and a timer set. In an example shown in FIG. 13, the pattern of the ACT voltage indicates that a first period is "VSS". The timer set indicates that the first period is length of "t0". Therefore, the first period of the ACT voltage is t0 time and the ACT voltage in the first period is "0".

Similarly, the pattern of the ACT voltage indicates that the second period is "−". The timer set indicates that a second period is length of "t1". Therefore, the second period of the ACT voltage is t1 time and the ACT voltage in the second period is "−VAA".

Similarly, concerning all periods of the ACT voltage, lengths and voltages in the periods are determined.

The INA voltage is generated in the same manner. The voltage to be applied to the actuators 37 is a difference between the ACT voltage and the INA voltage.

Note that, if a polarization direction of the actuators 37 is opposite, the voltage to be applied to the electrodes 33 should have a polarity opposite to the polarity described above.

Figure 14:
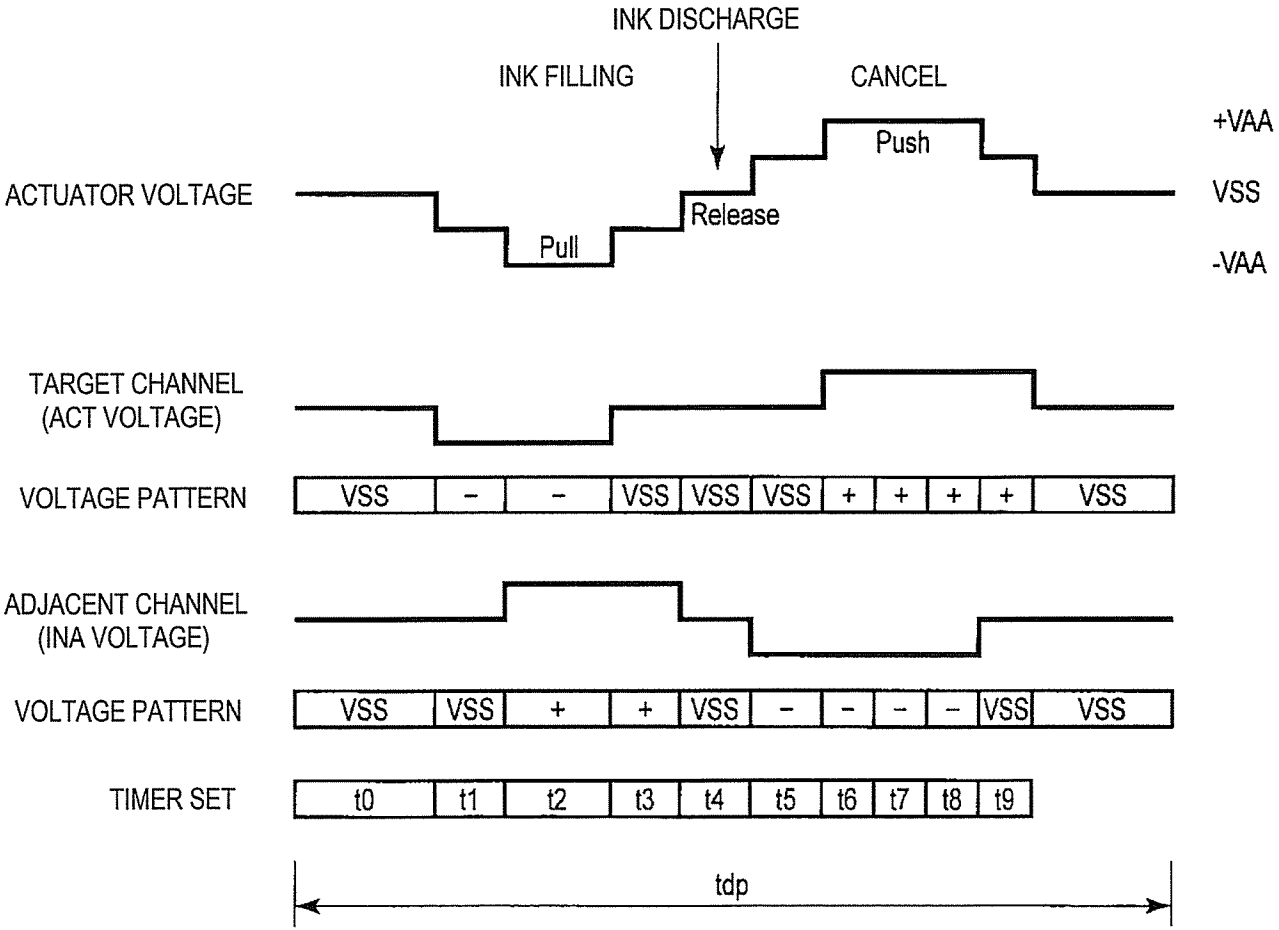
FIG. 14 is another timing chart showing the voltage applied to the actuators of the discharge unit.

FIG. 14 is another timing chart showing the voltage to be applied to the actuators 37, the ACT voltage, and the INA voltage.

In an example shown in FIG. 14, a timer set does not store t10 and stores the discontinuation time tdp. Time from t0 to t9 stored by the timer set is shorter than the discontinuation time tdp.

As shown in FIG. 14, in an eleventh period of the ACT voltage, a state of "VSS" continues to the discontinuation time tdp. Similarly, in an eleventh period of the INA voltage, the state of "VSS" continues to the discontinuation time tdp.

Figure 15:
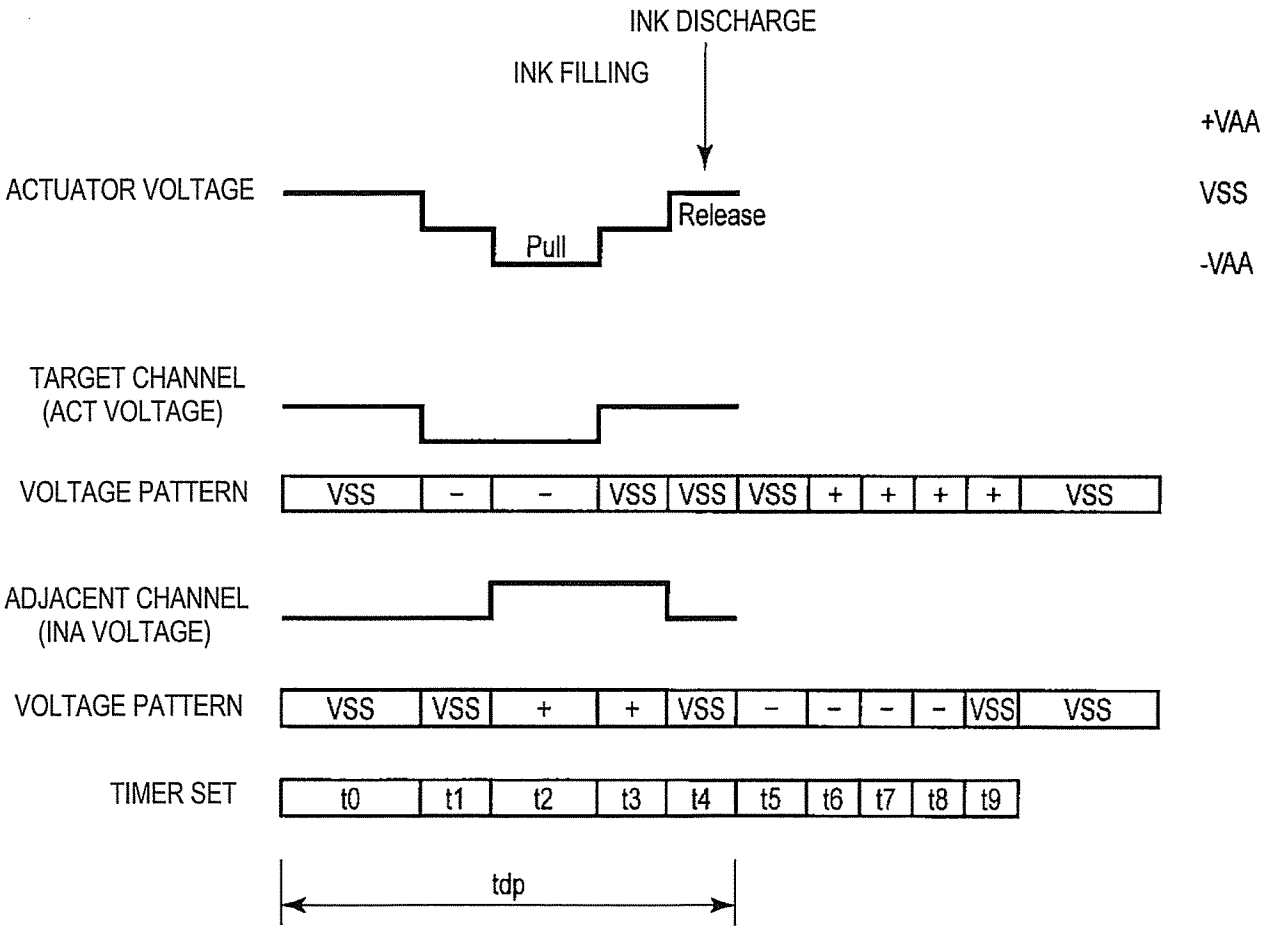
FIG. 15 is still another timing chart showing the voltage applied to the actuators of the discharge unit.

FIG. 15 is still another timing chart showing the voltage applied to the actuators 37, the ACT voltage, and the INA voltage.

In an example shown in FIG. 15, a timer set does not store t10 and stores the discontinuation time tdp. Time from t0 to t9 stored by the timer set is longer than the discontinuation time tdp.

As shown in FIG. 15, the driving circuit 22 generates the ACT voltage and the INA voltage until the discontinuation time tdp but does not generate the ACT voltage and the INA voltage after the discontinuation time tdp. If the discontinuation time tdp elapses, the driving circuit 22 ends the discharge operation for one drop.

By setting the discontinuation time tdp in this way, it is possible to select whether all voltage patterns of the registers that store voltage patterns of the ACT voltage, the INA voltage, and the like are executed or the voltage patterns are only executed halfway. That is, if the discontinuation time tdp is set long as shown in FIG. 14, all the voltage patterns are executed and cancellation is performed after discharge. However, if the discontinuation time tdp is set short as shown in FIG. 15 and the voltage patterns are only executed halfway, only the discharge is executed and a cancel pulse for changing the actuators to the state shown in FIG. 4 is omitted.

Making use of the above, if a value of the discontinuation time tdp is changed for every number-th drop, it is also possible to perform waveform generation for selecting presence or absence of the cancel pulse according to a number-th drop, although the registers that store the voltage patterns are common to the number-th drops.

Figure 16:
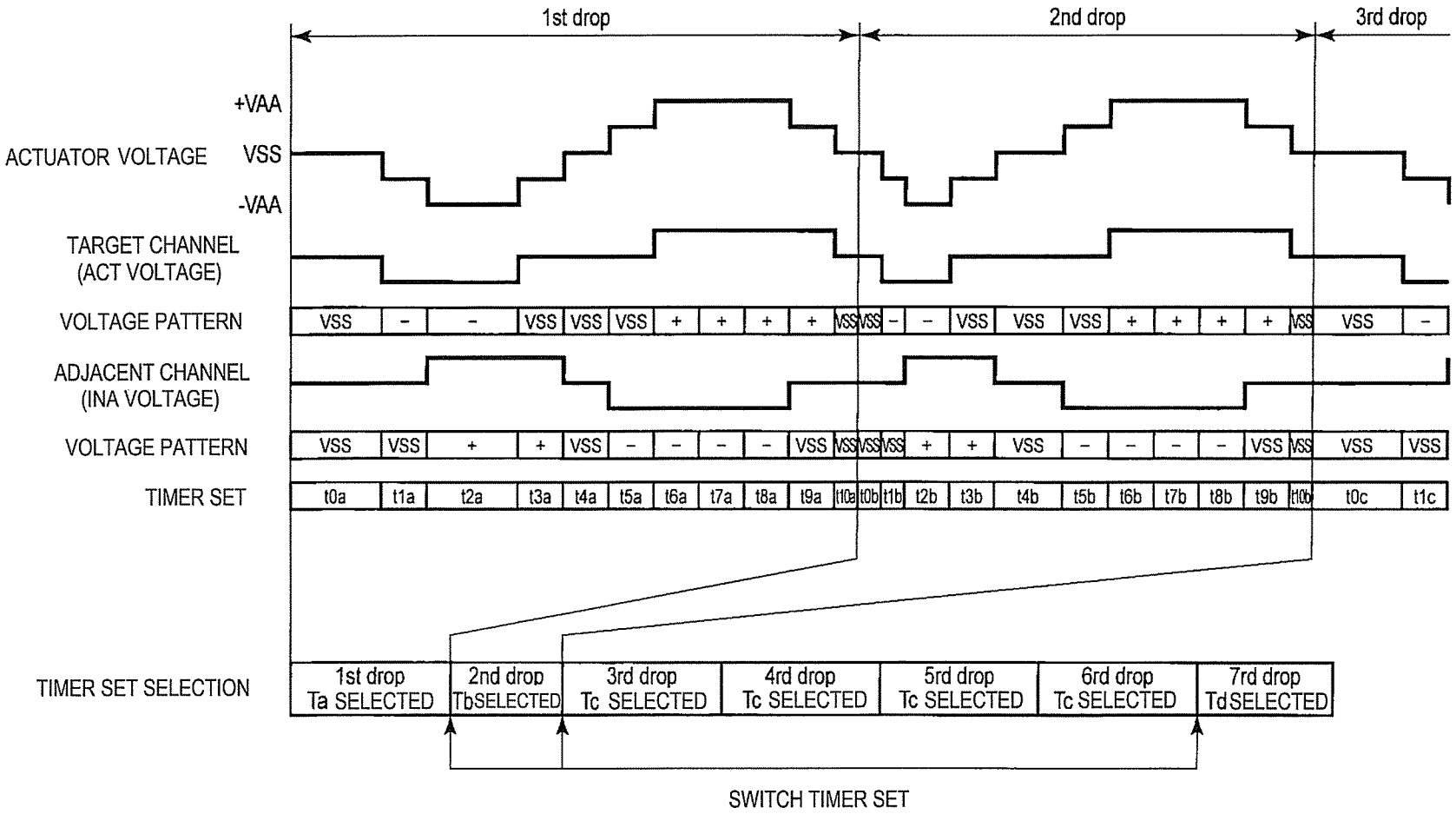
FIG. 16 is a timing chart showing a voltage for a plurality of drops applied to the actuators of the discharge unit.

For example, it is also possible to perform waveform generation for omitting the cancel pulse for the first drop because vibration of ink pressure in a pressure chamber is relatively small because of the influence of thixotropy of the ink and hysteresis of the actuators and adding the cancel pulse only to the second and subsequent drops. Consequently, time required for driving can be saved by time of the omitted cancel pulse for the first drop. It is possible to increase the speed of printing by the saved time. FIG. 16 is a timing chart showing the voltage applied to one actuator 37 in a discharge operation for seven drops, the ACT voltage, and the INA voltage.

In the discharge unit 21 according to the embodiment, the target division can continuously discharge the ink to one place seven times. Therefore, FIG. 16 is a timing chart from the start to the end of discharge to a certain place of the printing medium by the target division. In an example shown in FIG. 16, the driving circuit 22 causes the discharge unit 21 to continuously discharge the ink seven times.

The timer-set drop application register 46 stores the timer set Ta as a timer set for the first drop, stores the timer set Tb as a timer set for the second drop, stores the timer set Tc as timer sets for the third to sixth drops, and stores the timer set Td as a timer set for the seventh drop.

An operation example of the ink jet head 18 is explained. The operation example is explained according to the timing chart shown in FIG. 16.

First, the CPU 11 starts printing on the basis of, for example, an instruction received from the outside. When the printing is started, the CPU 11 feeds, with the conveying motor 19, a sheet to a position where the ink jet head 18 discharges the ink.

After the CPU 11 feeds the sheet, the selector 47*a* of the waveform generating unit 47 selects the timer set Ta as the timer set for the first drop according to a selection signal transmitted by the timer-set drop application register 46. If the selector 47*a* selects the timer set Ta, the timer 47*b* sets lengths of periods of a waveform according to the timer set Ta. The waveform generating unit 47 generates waveforms of the ACT voltage, the INA voltage, the NEG voltage, and the NEGINA voltage according to the lengths of the periods set by the timer 47*b*. The waveform generating unit 47 transmits information indicating the generated waveforms of the voltages to the waveform-frame and waveform-distribution control unit 48.

The target-waveform control unit 53 of the waveform-frame and waveform-distribution control unit 48 sets the waveform of the ACT voltage and the waveform of the NEG voltage on the basis of information indicating the waveform of the ACT voltage and information indicating the waveform of the NEG voltage. The adjacent-waveform control unit 52 of the waveform-frame and waveform-distribution control unit 48 sets the waveform of the INA voltage and the waveform of the NEGINA voltage on the basis of information indicating the waveform of the INA voltage and information indicating the waveform of the NEGINA voltage. The data-transfer and latch control unit 51 receives a drop sequence from the drop-sequence generating unit 60.

The division control unit 54 transmits a switch signal based on the waveform of the ACT voltage and the waveform of the NEG voltage set by the target-waveform control unit 53 and the drop sequence to the HV switch unit 50 as a switch signal corresponding to the channel of the target division. The division control unit 54 transmits a switch signal based on the waveform of the INA voltage and the waveform of the NEGINA voltage set by the adjacent-waveform control unit 52 and the drop sequence to the HV switch unit 50 as a switch signal corresponding to the channel of the adjacent divisions.

The HV switch unit 50 receives switch signals corresponding to the channels from the division control unit 54. When the switch signals corresponding to the channels are received, the HV switch unit 50 applies a voltage to the actuators 37 of the channels according to the switch signals corresponding to the channels.

According to the operation explained above, the target channel can discharge the ink to the printing medium from the pressure chambers 36. In the example shown in FIG. 16, after the discharge operation for one drop ends, the selector 47*a* selects the timer set Tb as a timer set for the second drop according to a selection signal. Thereafter, the ink jet head 18 performs the same operation.

After the discharge operation for two drops ends, the selector 47*a* selects the timer set Tc as a timer set for the third drop according to a selection signal. The ink jet head 18 performs the same operation in all the number-th drops.

After the same operation is performed in all the number-th drops, the ink jet head 18 ends the discharge operation of the target division. After the discharge operation of the target division ends, the ink jet head 18 changes the setting of the target division and performs the same operation. After the ink jet head 18 ends the discharge operation for all the channels, the CPU 11 moves the sheet using the conveying motor 19 such that the ink jet head 18 can discharge the ink to the next printing position. After when the CPU 11 moves the sheet, the ink jet head 18 performs the discharge operation in the same manner. When the ink jet head 18 ends the discharge operation in all printing points, the CPU 11 ends the printing.

It is possible to freely set according to information stored in the timer-set drop application register 46 which timer set among Ta to Td is used in which number-th drop.

Note that the CPU 11 may move the ink jet head 18 with the carriage motor 20.

The driving circuit 22 may select the first timer set while the sheet is moving. The ink jet head 18 configured as explained above can change the timer set for each number-th drop. Therefore, the ink jet head 18 can adjust a discharge state such as discharge speed and a discharge volume for each drop. Consequently, the ink jet head 18 can stabilize printing quality.

The several embodiments of the present invention are explained above. However, the embodiments are presented as examples and are not intended to limit the scope of the invention. These new embodiments can be implemented in other various forms. Various omissions, substitutions, and changes can be performed without departing from the spirit of the invention. These embodiments and modifications of the embodiments are included in the scope and the gist of the invention and included in the inventions described in claims and the scope of equivalents of the inventions.

What is claimed is:

1. An ink jet head for ejecting a plurality of inks to form one pixel on a printing medium, comprising:

a discharge unit configured to discharge ink according to an operation of an actuator;

a first storing unit configured to store a pattern of a voltage to be applied to the actuator, the pattern of the voltage including a series of voltage values;

a second storing unit configured to store a plurality of time sets, each of which includes a series of time values;

a third storing unit configured to store selection data and a number representing a number-th drop corresponding to the selection data;

a waveform generating unit including a selector configured to select a timer set from the plurality of timer sets stored by the second storing unit, the waveform generating unit being configured to generate a waveform of the voltage by assigning one of the voltage values in the series of the voltage values to one of the time values in the series of the time values in the timer set selected by the selector in order; and a voltage applying unit configured to apply the voltage to the actuator on the basis of the waveform generated by the waveform generating unit, wherein the selector selects the timer set in accordance with the selection data, and wherein one or more inks, each of which is discharged in accordance with the waveform generated by the waveform generating unit, are continuously discharged from the discharge unit to form the pixel.

2. The inkjet head according to claim 1, wherein the plurality of timer sets store a discontinuation time when the generation of the waveform is discontinued, and if the discontinuation time stored by the timer sets elapses from a start of the generation of the waveform, the waveform generating unit ends the generation of the waveform.

* * * * *